United States Patent [19]

Steiner

[11] 3,947,939

[45] Apr. 6, 1976

[54] METHOD FOR THE MANUFACTURE OF TURBULATORS

[75] Inventor: Peter Steiner, Edison, N.J.

[73] Assignee: Foster Wheeler Energy Corporation, Livingston, N.J.

[22] Filed: July 18, 1974

[21] Appl. No.: 490,432

[52] U.S. Cl. ..... 29/157 R; 29/505; 259/4 R; 138/42

[51] Int. Cl.² ..... B21D 53/00; B21D 11/14

[58] Field of Search..... 416/176, 177; 113/116 W, 113/116 G; 29/157 R, 157.3 AH, 157.3 D, 456, 463, 505, DIG. 3; 259/4, DIG. 30; 138/42; 48/180 M

[56] References Cited

UNITED STATES PATENTS

| | | | |
|---|---|---|---|
| 607,932 | 7/1898 | Husham | 29/505 |
| 1,710,042 | 4/1929 | Bundy | 29/456 |
| 2,760,255 | 8/1956 | Compton | 29/156.8 |
| 3,128,536 | 4/1964 | Eckhardt | 29/155 |
| 3,328,868 | 7/1967 | Eckhardt | 29/157.3 AH |
| 3,426,852 | 2/1969 | Kinsey | 416/177 |
| 3,827,888 | 8/1974 | Terwilliger et al. | 259/4 |

FOREIGN PATENTS OR APPLICATIONS

| | | | |
|---|---|---|---|
| 2,056,301 | 6/1971 | Germany | 29/480 |
| 417,232 | 10/1934 | United Kingdom | 416/213 |
| 546,028 | 1956 | Italy | 259/4 |

*Primary Examiner*—C. W. Lanham
*Assistant Examiner*—Dan C. Crane
*Attorney, Agent, or Firm*—Marvin A. Naigur; John E. Wilson

[57] ABSTRACT

A multivane turbulator has been provided wherein at least two "V"-shaped members forming the vanes thereof are disposed with their vertices adjacent one another and twisted about each other such that the pitch of the twist is sufficient to render the turbulator self-supporting with symetrically disposed vanes about a central axis.

The method of forming the turbulators includes the steps of bending at least two strips of flat stock into "V"-shaped members and disposing one adjacent the other at their vertices and twisting same until the vanes are self-supporting.

6 Claims, 5 Drawing Figures

METHOD FOR THE MANUFACTURE OF TURBULATORS

BACKGROUND OF INVENTION

In certain chemical processes it is necessary to conduct fluid in both gaseous and liquid form through tubes during different stages of the specific process. In certain instances it is necessary to impart turbulence to the fluid in order to enhance the mixing quality to the flow and as such it is necessary to insert in the tubes or conduits means for creating turbulence. One such device is a multivane turbulator, which is a member which fits within the tube or conduit and resembles a spiral such that the liquids or fluids will flow about the vanes of the spiral thus creating the required turbulence.

The manufacture of these devices has been quite complicated and expensive in the past because of the special apparatus necessary to produce the device. For example, certain methods require the joining of strips of flat stock at a central point, welding the stock together and twisting the stock in order to produce the turbulator. Other methods include wrapping a flat member about a central axis support member and welding the member at different points along the support member. Both of the aforementioned methods require production costs and time, which the present invention has as one of its purposes to reduce.

When it is necessary to produce turbulators with a large number of vanes, for example, six or eight, the aforementioned processes become even more difficult and expensive to accomplish since the materials become cumbersome in handling. The present system of producing multivane turbulators, therefore, is designed to permit production of turbulators having different numbers of vanes as required for a particular process.

It is, therefore, an object of the present invention to provide a method for producing multivane turbulators which are simple and require relatively inexpensive production apparatus and materials.

It is another object of the present invention to produce multivane turbulators which are self-supporting and require little or no welding to produce.

It is another object of the present invention to provide a simplified method for producing multivane turbulators in order to reduce production costs and time.

SUMMARY OF INVENTION

A multivane turbulator has been provided wherein at least two "V"-shaped members forming the vanes thereof are disposed with their vertices adjacent one another and twisted about each other such that the pitch of the twist is sufficient to render the turbulator self-supporting with symetrically disposed vanes about a central axis.

The method of forming the turbulators includes the steps of bending at least two strips of flat stock into V-shaped members and disposing one adjacent the other at their vertices and twisting same, thereby rendering the vanes self-supporting.

For a better understanding of the present invention together with other and further objects thereof, reference is directed to the following description taken in connection with the accompanying drawings, while its scope will be pointed out in the appended claims.

DESCRIPTION OF THE PREFERRED EMBODIMENTS

Figure 1:
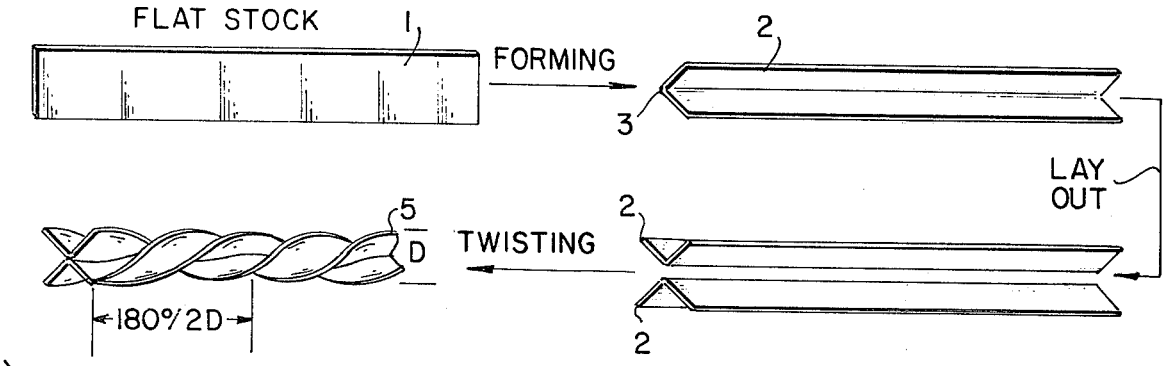
FIG. 1 shows diagramatically the steps involved in forming the turbulator of the present invention.

FIG. 1 shows the steps for producing the apparatus for the present invention. These steps include forming from segments of flat stock 1, V-shaped members 2, thereafter laying out the V-shaped members with their vertices 3 adjacent one another and thereafter imparting a twist to the members so that the turbulator 5 is formed. The method described above requires no welding generally, if the V-shaped members 2 are twisted to a pitch of about 180° for an equivalent of a distance of about two diameters D of the turbulator. The proportions thereof are shown in connection with the turbulator 5 of FIG. 1.

Figure 2:
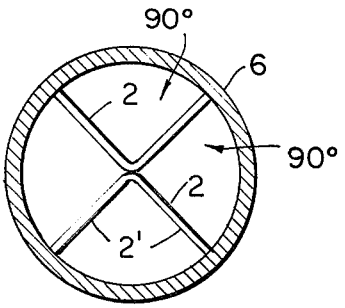
FIG. 2 shows in crossection a turbulator of the present invention inserted in a tube.

The turbulator 5 formed as a result of the process illustrated in FIG. 1 is shown in cross section in FIG. 2 in a tube member 6. The turbulator 5 which is shown is a four-vane turbulator with the bend formed in the V-shaped member 2 at approximately 90 degrees.

Figure 3:
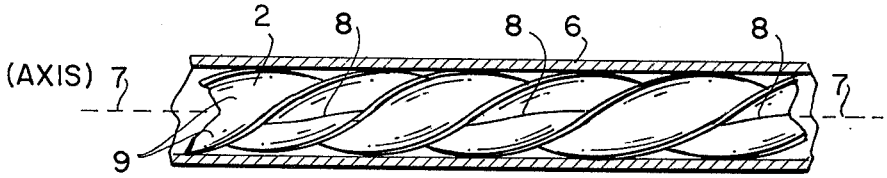
FIG. 3 shows the turbulator of FIG. 2 in fragmented elevation with the tube being shown in cross section.

In FIG. 3 the same turbulator 5 is shown lengthwise disposed in the tube 6, the axis 7 of which appears through alternating seam sections 8 of the device. Since the V-shaped members 2 are twisted about each other, a plurality of vanes 9 are formed with the seam sections 8 conforming to the axis 7 of the turbulator 5 and therefore no support member is necessary. If the pitch of the vanes 9 is sufficient, the turbulator 5 will need no welding to keep the members 2 alligned laterally. The advantages of such a system and method are clear, since the vanes 9 of the turbulator 5 are rigid and the method is extremely simple to implement.

The turbulator 5 may be formed with one end fixed in a vise or the like and the other is secured in a head which may be rotated relative to the fixed end. Alternately the devise may be twisted at both ends in a controlled fashion or any convenient way so that the pitch of the turbulator is controlled to form a self-supporting member.

It should be understood that the method of the present invention may form a turbulator 5 having vanes 9 of varying pitch. If a slight pitch were required, however, there might be slippage of one member 2 relative to the other and tack welding would be necessary in order to keep the turbulator vanes fixed relative one to the other.

Figure 4:
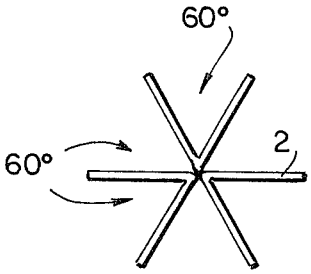
FIGS. 4 and 5 show alternate embodiments of the present invention with different numbers of turbulator vanes.
Figure 5:
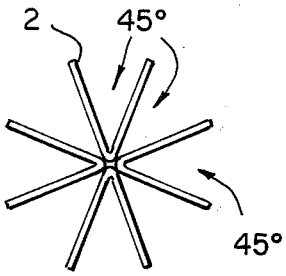

In FIGS. 4 and 5 alternate embodiments of the present invention are shown wherein six and eight vane turbulators are illustrated respectively. The V-shaped members 2 in FIG. 4 and 5 have approximately 60° and 45° bends respectively, so as to be disposed radially about the 360° circumference of the tube 6. The radial portions of the V-shaped members 2 may be disposed unevenly if required for a particular application.

There are limits to the number of vanes 9 which can be formed which correspond to the thickness of the stock 1 ultilized in the forming of the V-shaped members 2. As a practical matter, in the processes contemplated, eight vaned turbulators (FIG. 5) will probably be all that will be required. It is, of course, possible to form turbulators with numbers of vanes exceeding eight as shown in FIG. 5. The embodiments of FIGS. 4 and 5 as well as that of FIG. 2 are shown in order to illustrate the manner in which the number of vanes 9 may be multiplied for particular requirements. A ten vane turbulator could be produced by twisting five V-shaped members 2 having an angle bend of 36° for a regular radial configuration.

The advantages of the present invention permit the simple and inexpensive fabrication of turbulator vanes on a production basis. It is no longer necessary to weld the members together except for very short devices or those with a relatively small pitch. Bending the vanes about a central axis or core requiring expensive apparatus and skilled workmen is no longer necessary.

While other pitch configurations are possible, a pitch of about 180° for about 2 diameters D of the turbulator 5 is convenient for certain processes and renders the turbulator 5 self-supporting. However, if a looser pitch proved desirable, a longer length of turbulator-V-shaped member could be used for a self-supporting device.

While there have been described what at present are considered to be the preferred embodiments of the present invention, it should be understood that certain modifications and changes may be made therein without departing from the spirit of the invention, and is therefore intended in the appended claims to cover all such modifications and changes as fall within the true spirit and scope of the invention.

What is claimed is:

1. A method of forming a multivane turbulator for insertion into a tube comprising: bending at least two strips of flat stock into V-shaped members, disposing said V-shaped members in a position which is adjacent their vertices and twisting said V-shaped members together from an end so as to form a plurality of vanes having a pitch self-supporting such that said vanes generally extend radially in cross section, and inserting the turbulator so formed into said tube.

2. The method of claim 1 wherein said V-shaped members are bent at angles of about 90°.

3. The method of claim 1 wherein three V-shaped members are bent at angles of about 60° and are twisted together.

4. The method of claim 1 wherein four V-shaped members are bent at about 45-degree angles and are twisted together.

5. The method of claim 1 wherein the pitch of the twist is approximately 180° for a distance of about two diameters of the turbulator.

6. The method of claim 1 wherein the vanes are generally symetrically disposed about a central axis of the turbulator when V-shaped members of the same approximate angular bend are twisted.

* * * * *